US006250630B1

(12) United States Patent
Moll

(10) Patent No.: US 6,250,630 B1
(45) Date of Patent: Jun. 26, 2001

(54) ELECTRONICALLY ACTUATED TURNING DEVICE FOR TRANSPORT APPARATUS

(75) Inventor: Richard J. Moll, Doylestown, PA (US)

(73) Assignee: Moll Group LLC, Warminster, PA (US)

( * ) Notice: Subject to any disclaimer, the term of this patent is extended or adjusted under 35 U.S.C. 154(b) by 0 days.

(21) Appl. No.: 09/455,903

(22) Filed: Dec. 7, 1999

(51) Int. Cl.[7] ..... B65H 5/00

(52) U.S. Cl. ..... 271/225; 271/227; 271/248; 271/253; 271/184

(58) Field of Search ..... 271/225, 227, 271/229, 248, 253, 184, 185

(56) References Cited

U.S. PATENT DOCUMENTS

| | | | | |
|---|---|---|---|---|
| 5,114,137 | * | 5/1992 | Olson | 271/184 |
| 5,224,696 | * | 7/1993 | Kellum | 271/184 |
| 5,568,920 | * | 10/1996 | Moll | 271/225 |
| 5,788,228 | * | 8/1998 | Moll | 271/225 |
| 5,984,302 | * | 11/1999 | Garrone | 271/227 |

* cited by examiner

*Primary Examiner*—H. Grant Skaggs
(74) *Attorney, Agent, or Firm*—Zachary T. Wobensmith, III

(57) ABSTRACT

An electronically actuated turning device for transport apparatus, which apparatus use endless belts for transport, which detects the presence of products being transported such as paper folders, activates a solenoid to cause an upper swivel ball to contact the product and engage a lower swivel ball, which grips and stops the product, and allows the product to rotate 90 degrees, and then releases the product, which product is then transported in the original direction by the apparatus for further operations as required.

6 Claims, 5 Drawing Sheets

FLOW DIRECTION
60
61
56
31
30
10A
34
18
62
12
16
18
25
26
46
45
55
10B
63
65
71
73
66
67
64
20
72
70
50
21
35A
36
37
35
24
20
19
14
15
40
11
39A
38
38A
39
29
31
30
31
45
46
26
25
31
30
10A
34
18
62
12
16
18

FLOW DIRECTION
60
61
56
31
30
25
26
46
29
38A
39
38
40
12
15
14
19
20
36
35A
35
37
39A
45
50
21
70
72
20
71
67
66
73
55
10B
65
64
63
18
62
16
10A
34

ELECTRONICALLY ACTUATED TURNING DEVICE FOR TRANSPORT APPARATUS

BACKGROUND OF THE INVENTION

1. Field of the Invention

This invention relates to an electronically actuated turning device for transport apparatus, which apparatus uses endless belts for transport, and is of the type which detects the presence of products, grips and changes the orientation of the products by 90 degrees during their travel, and releases them to continue travel in the original direction.

2. Description of the Prior Art

Various folded paper products such as folded paper jackets often require that the product be turned 90 degrees for processing, such as performing pocket folds, or stacking.

Folded paper products are usually transported on endless belts, which deposit them on intersecting belts that are perpendicular to the original direction of travel, and from which they are further processed. The common prior art transport for turning products is expensive, requires additional belts and equipment, and takes up additional space.

In my prior U.S. Pat. No. 5,568,920, a mechanical turning device for transport apparatus is disclosed, that includes a bump housing attached to a support bar, with a rotatable bump ball above a metal plate, which ball intercepts products that are carried on an endless belt, stops the product by gripping it between it and the plate, with further belt motion rotating the product 90 degrees until it strikes a guide bar, and which then transports the product for further processing.

While my prior device is suitable for its intended purpose, it requires precise height adjustment to accommodate different thicknesses of product, and relies on friction between it and a metal plate to stop and turn the product.

In my prior U.S. Pat. No. 5,788,228 is disclosed an electronically actuated turning device for transport apparatus, which includes apparatus to detect a product, actuates a solenoid to cause a ball to contact a product and grip it between it and a metal plate, the product is rotated 90 degrees, the solenoid actuated to retract the ball, and the product continues to be transported.

While this device is satisfactory for its intended purpose, the product may become damaged due to the uncertainties of the frictional characteristics of this ball and plate combination.

The device of the invention does not suffer from the shortcomings of the prior art, and provides many positive advantages.

SUMMARY OF THE INVENTION

It has now been found that an electronically actuated device is available, that is used with a transport apparatus, that has endless transport belts, which device grips and stops products, changes their orientation by 90 degrees, and then releases them to continue being transported in the original direction.

The principal object of the invention is to provide an electronically actuated turning device for transport apparatus that changes the products' orientation by 90 degrees, while being transported.

A further object of the invention is to provide a device of the character aforesaid that is fast and positive in its operation.

A further object of the invention is to provide a device of the character aforesaid that is easily adjustable to accommodate products of different width and thickness.

A further object of the invention is to provide a device of the character aforesaid that is durable and long lasting in operation.

Other objects and advantageous features of the invention will be apparent from the description and the claims.

DESCRIPTION OF THE DRAWINGS

The nature and characteristic features of the invention will be more readily understood from the following description taken in connection with the accompanying drawings forming part hereof in which.

Figure 1:
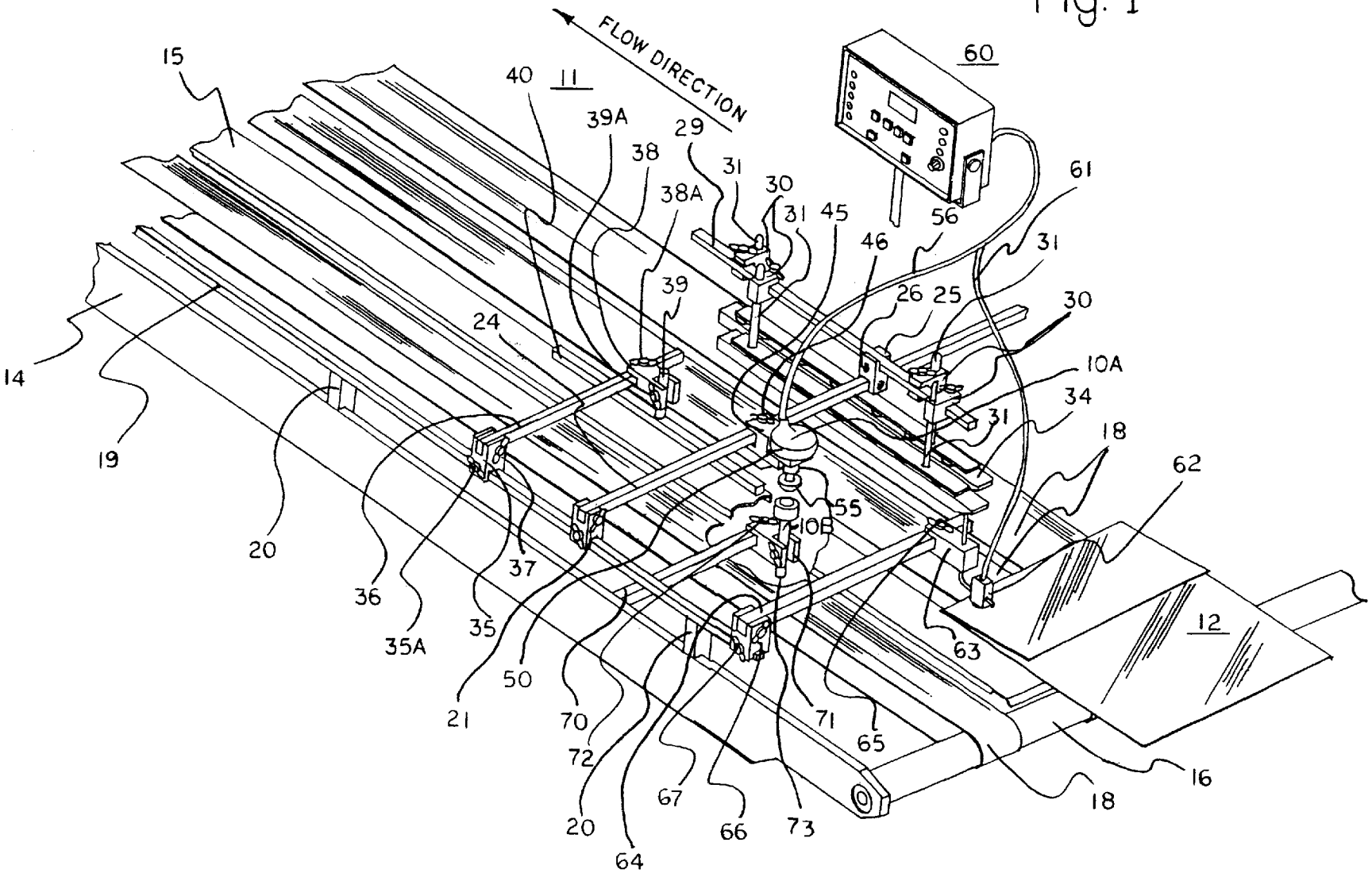
FIG. 1 is a perspective view, partially broken away, of the electronically actuated turning device of the invention, installed on a transport apparatus.

It should of course be understood that the description and drawings herein are merely illustrative, and that various modifications and changes can be made in the structure disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Referring now more particularly to FIGS. 1–5 of the drawings, one embodiment of the turning device 10, which includes an upper component 10A and a lower component 10B, is illustrated in operation on a transport apparatus 11. The transport apparatus 11 is typical of such apparatus, which transport or convey various products, such as folded paper jackets 12. The apparatus 11 includes a frame (not shown), having a bed (not shown), and at least one side rail 14. The bed (not shown) includes a support pan 15, which is smooth and preferably of metal, with a rotatable roller 16 extending from the rail 14 across the front of the apparatus.

A plurality of endless belts 18 of well known type are provided, engaged with roller 16 and extending along the bed (not shown) for transporting or conveying jackets 12. The side rail 14 has a longitudinal bar 19 engaged therewith by blocks 20 and extends therealong. A bracket 21 is attached to bar 19 and carries one end of a support bar 24, which extends transversely across the bed, and is attached to a bar (not shown) on the other side of the bed.

The support bar 24 has a bracket 25 attached thereto and movable therealong, with a thumbscrew 26 to secure it at selected locations on bar 24. The bracket 25 has a top drive bar 29 attached thereto, with a thumbscrew 26 therein to restrain drive bar 29 at desired locations. The top drive bar 29 has brackets 30 engaged therewith, with rods 31 attached thereto and to marble holders 34 of well known type, which have marbles (not shown) which engage the folders 12 and restrain them from vertical movement but permit passage underneath the marble holders 34. The bar 19 has a bracket 35 engaged therewith, with a thumbscrew 35A to restrain its movement. The bracket 35 has a guide support bar 36 engaged therewith, which is restrained thereon by thumbscrew 37, and which extends across the bed. An additional bracket 38 is engaged with bar 36, with a thumbscrew 38A therein for adjustment, with a rod 39 engaged therewith, with a thumbscrew 39A for adjustment, and with a guide bar 40 which extends in the direction of travel of belts 18. The guide bar 40 guides folders 12 after rotation to be described.

The support bar 24 also carries a mounting clamp 45 engaged with the upper component 10A of turning device 10, which has a thumbscrew 46 for positioning of clamp 45 on bar 24.

Figure 2:
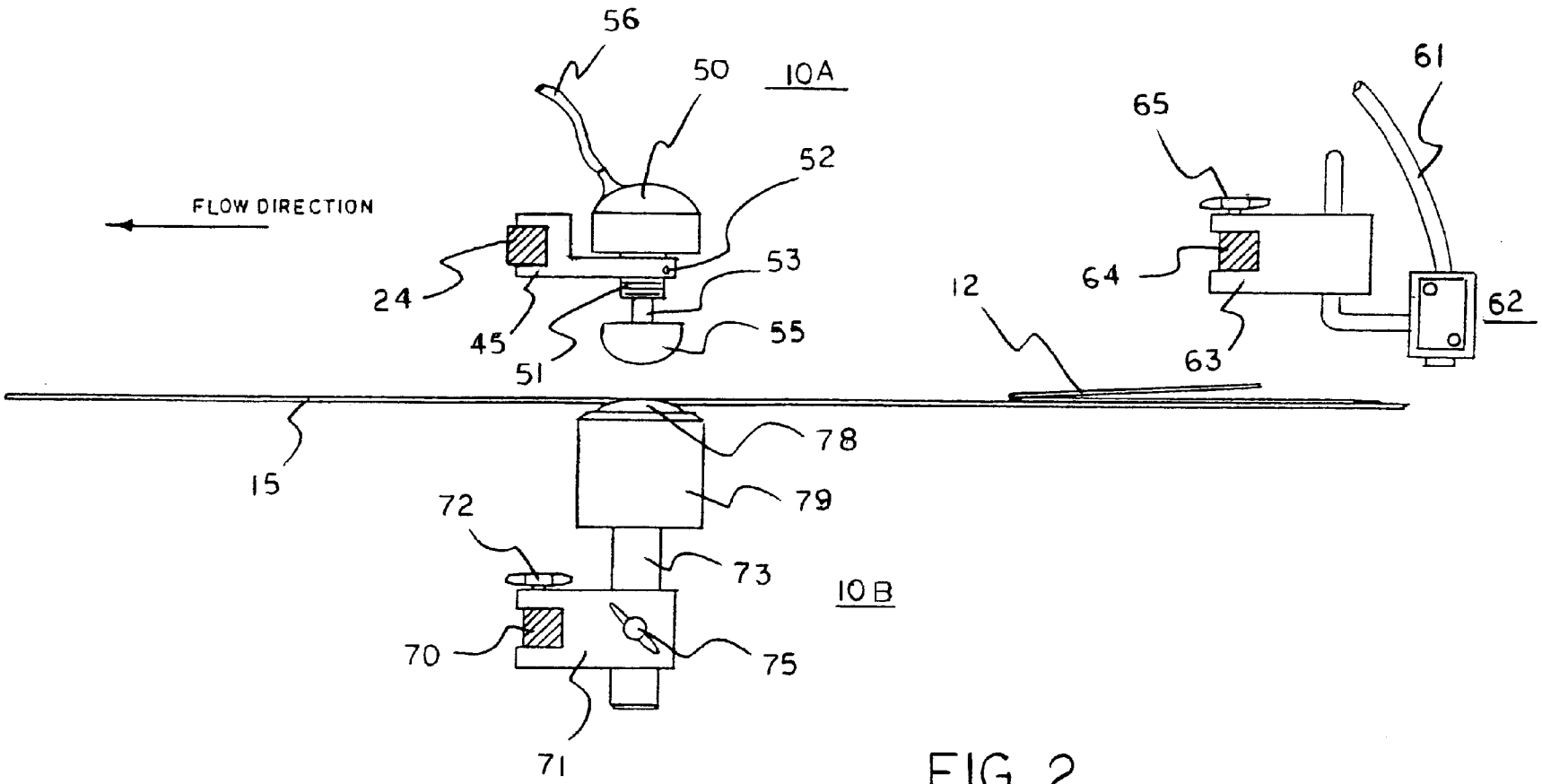
FIG. 2 is a left side view of the turning device of the invention.
Figure 3:
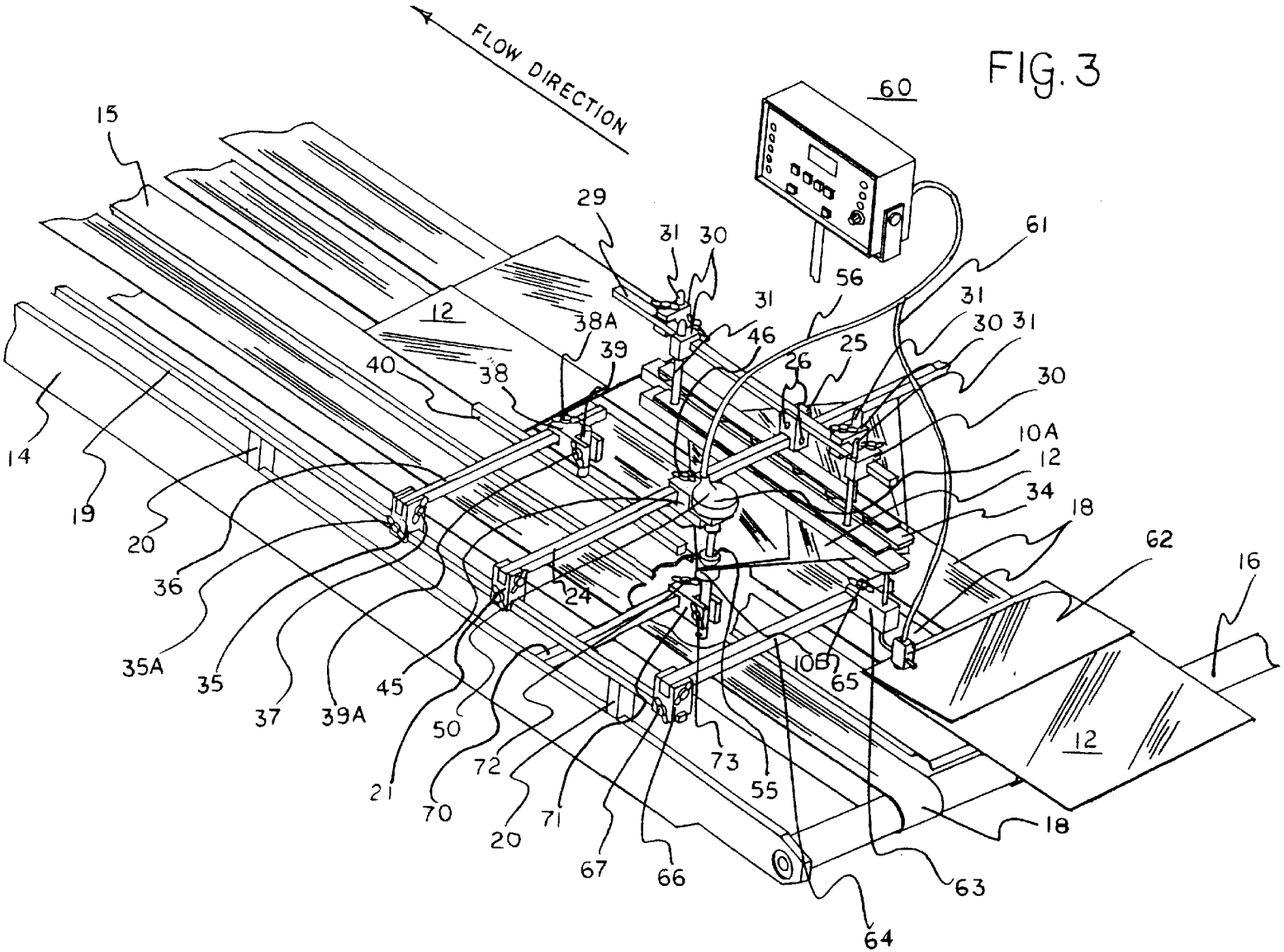
FIG. 3 is a perspective view similar to FIG. 1 illustrating the turning action of a product.
Figure 4:
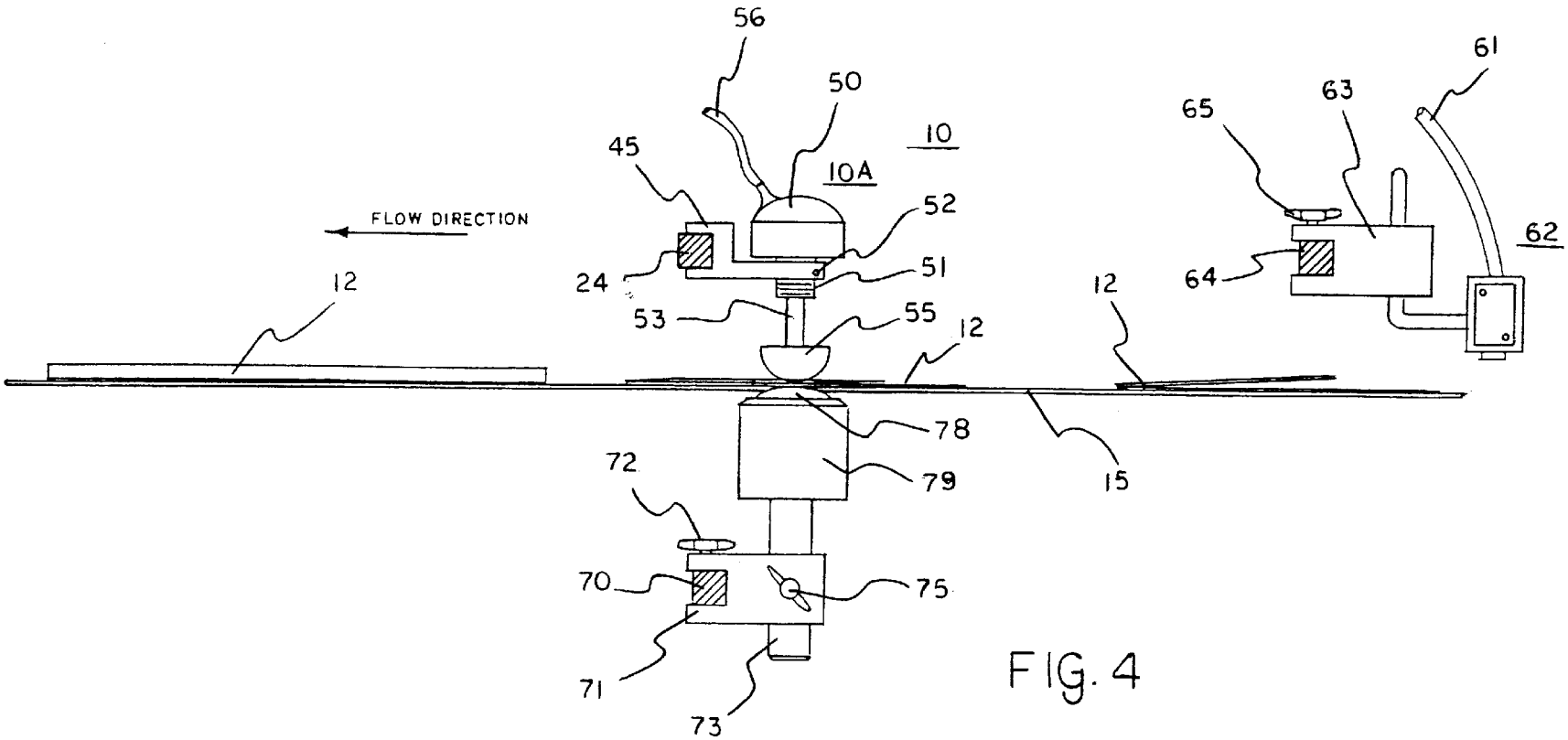
FIG. 4 is a view similar to FIG. 2 of the product during its turning.
Figure 5:
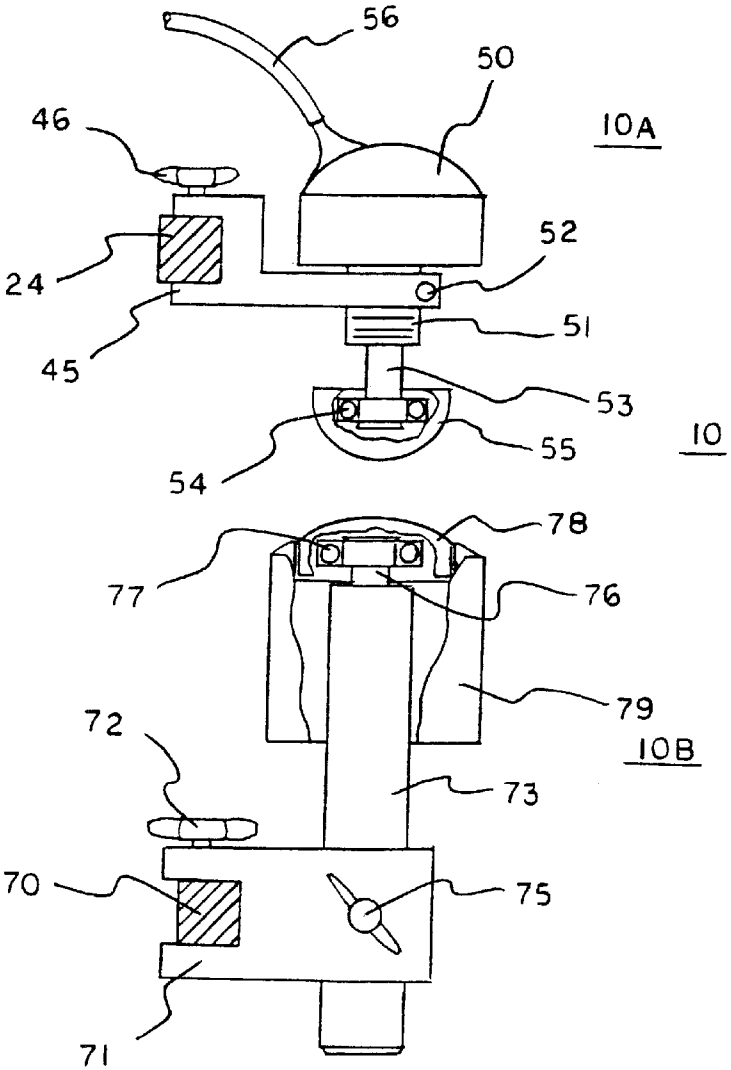
FIG. 5 is a left side, fragmentary view of the device of the invention, in partial vertical section.

As shown in detail in FIGS. 2, 4, and 5, the clamp 45 has a solenoid 50 mounted thereto, with a housing 51 secured in clamp 45 by a lock screw 52. The solenoid 50 has a vertically movable stem 53 extending therefrom, with a ball bearing 54 secured thereon in well known manner, with a swivel ball 55 engaged with the ball bearing 54 and freely rotatable about stem 53. The ball 55 can be formed of any suitable material with neoprene plastic being the preferred material.

The solenoid 50 has a cable 56 connected thereto and to a controller 60 of well known type, such as the Glue Bind Quadra Plex controller available from Dick Moll & Sons, Inc., Warminster, Pa. The controller 60 has a cable 61 connected thereto, and to an electric eye 62, which is mounted by a clamp 63 to a bar 64, and restrained from movement by a thumbscrew 65, which bar 64 is mounted to bar 19 by a clamp 66, and has a thumbscrew 67 therein.

The electric eye 62 is of well known type and detects the presence of a folder 12, signals the controller 60, which has a programmable delay time to enable the folder to come under ball 55, at which time the solenoid 50 is activated and ball 55 is moved down to contact folder 12 to be described.

The controller also has a linear motion sensor (not shown), which signals the controller of the speed of belts 18, which permits the controller to determine the position of the folder 12.

As shown in the Figs., the upper component 10A is located so that the ball 55 is positioned between the pan 15 and an endless belt 18.

A lower support bar 70 is provided, connected to side rail 14, and which extends transversely across the bed, and has a mounting clamp 71 thereon, with a thumbscrew 72 to secure it at selected locations on bar 70. The clamp 71 has a shaft 73 therein, which is part of lower component 10B of turning device 10, and clamp 71 has a thumbscrew 75 therein for vertical movement for adjustment of component 10B, as required for contact with folders 12 to be described.

The shaft 73 has a mounting stem 76 therein, which has a ball bearing 77, retained thereon in well known manner. The ball bearing 77 has a swivel ball 78 thereon, which is free to rotate about stem 76. The stem 76 also has a plastic shield 79 thereon, around the edge of ball 78 and over stem 76.

The ball 78 can be formed of any suitable material with neoprene plastic being the preferred material.

The mode of operation will now be pointed out.

Folders 12 are fed onto belts 18 to be transported and turned 90 degrees during transport. The upper and lower turning device components 10A and 10B are adjusted for the thickness of the folders 12.

As a folder 12 is transported it is detected by the electric eye 62, which signals controller 60, which controller starts the delay time running, and when a folder is between the swivel balls 55 and 78 actuates the solenoid 50 to cause stem 53 to move downwardly and ball 55 to contact folder 12 which is engaged by ball 78. The controller has a programmable hold time to enable the folder 12 to be swung about turning device 10. The belts 18 continue to move and the folder 12 is swung about the device 10 under marble holders 34, which belts supply the drive to rotate folder 12 until it strikes guide bar 40, at which time solenoid 50 is released and ball 55 moves upwardly releasing folder 12, which has been turned 90 degrees and is transported on belts 18 for further processing. The operation continues with subsequent folders 12.

It will thus be seen that a device has been provided with which the objects of the invention are achieved.

I claim:

1. An electronically actuated turning device for turning products which are being conveyed on endless belts, which belts are carried on a bed of a transport apparatus, which products are turned at at least a 90 degree angle from their original orientationn while being transported, and which products continue to be transported in their original direction, which comprises a side rail, a longitudinal bar attached to said side rail, support bar means attached to said longitudinal bar and extending transversely across said bed, bracket means attached to said support bar means and positionable at selected locations thereacross, marble guide bar means attached to said bracket means and positionable to engage said products which pass between it and said bed, a longitudinal support pan connected to said bed, mounting clamp means attached to said support bar means and positionable thereacross, upper turning component means engaged with said mounting clamp means, means for varying the vertical position of said upper turning component means, said upper turning component means includes a solenoid, a cable connected to said solenoid, controller means controlling the operation of said solenoid and connected to said cable means connected to said controller by a cable for signalling the controller of the presence of a product, said solenoid having a stem extending therefrom, upper swivel ball means connected to said stem for selective contact with said product for rotation of said product, a lower support bar connected to said side rail and extending under said belts, lower turning component means carried on said lower support bar and positionable therealong, said lower turning component means including a clamp carried on said lower support bar, a shaft carried by said clamp and vertically positionable, said shaft having a stem therein, lower swivel ball means in alignment with said upper swivel ball means, and carried on said stem for contact with said product for turning said product, a guide support bar mounted to said longitudinal bar and extending transversely across said bed, a bracket engaged with said guide support bar and positionable thereacross, a rod engaged with said guide support bar bracket and, a guidebar engaged with said rod, and which is oriented in the direction of conveyance of said product to receive and guide said product after it is rotated by said upper and lower swivel ball means.

2. An electronically actuated turning device as defined in claim 1 in which said upper swivel ball means includes a ball bearing carried on said stem and a swivel ball engaged with said bearing for rotation about said stem, said lower swivel ball means includes a ball bearing carries on said stem a swivel ball engaged with said ball bearing for rotation about said stem and a plastic shield carried by said lower swivel ball.

3. An electronically actuated turning device as defined in claim 2 in which upper and said lower swivel balls are formed of neoprene plastic.

4. An electronically actuated turning device as defined in claim 1 in which said means for detecting the presence of a product is an electric eye.

5. An electronically actuated turning device as defined in claim 1 in which said controller means has a delay tine for delaying the operation of said solenoid until said product is between said upper and lower swivel ball means.

6. An electronically actuated turning device as defined in claim 1 in which said controller means has a holding time to determine the degree of turning of the folders.

* * * * *